US011946281B1

(12) United States Patent
Brezner

(10) Patent No.: US 11,946,281 B1
(45) Date of Patent: Apr. 2, 2024

(54) BUOYANT SKIMMER APPARATUS

(71) Applicant: Michael Brezner, Jamestown, NY (US)

(72) Inventor: Michael Brezner, Jamestown, NY (US)

( * ) Notice: Subject to any disclaimer, the term of this patent is extended or adjusted under 35 U.S.C. 154(b) by 0 days.

(21) Appl. No.: 18/369,821

(22) Filed: Sep. 18, 2023

(51) Int. Cl.
*E04H 4/16* (2006.01)
*E04H 4/12* (2006.01)

(52) U.S. Cl.
CPC ..... *E04H 4/1609* (2013.01); *E04H 4/1263* (2013.01)

(58) Field of Classification Search
CPC ..... E04H 4/1609; E04H 4/1263
USPC ..... 210/776, 470, 471, 238, 167.2
See application file for complete search history.

(56) References Cited

U.S. PATENT DOCUMENTS 4,040,864 A * 8/1977 Steeves ..... E04H 4/1681 210/167.17
4,089,074 A * 5/1978 Sermons ..... E04H 4/1254 210/167.2
4,263,864 A 4/1981 Carter, Jr. et al.
5,350,508 A * 9/1994 Van der Watt ..... E04H 4/1263 210/167.2
5,422,001 A 6/1995 Yagoda et al.
5,705,058 A 1/1998 Fischer
5,849,184 A * 12/1998 Veillet ..... E04H 4/1254 210/167.2
5,915,431 A 6/1999 Doussan
6,358,410 B1 3/2002 Lambert
6,984,315 B2 1/2006 Dolton, III
7,033,490 B2 4/2006 Blackman et al.
8,877,047 B2 11/2014 Stroeder
2004/0108259 A1 6/2004 Giannantonio
2014/0263031 A1* 9/2014 Lawson ..... B25G 1/00 56/400.01
2021/0285248 A1 9/2021 McCutchen

* cited by examiner

*Primary Examiner* — Fred Prince
(74) *Attorney, Agent, or Firm* — Law Office of Vincent LoTempio, PLLC; Vincent G. LoTempio; Robert Cerasa

(57) ABSTRACT

According to the embodiments illustrated herein, is an apparatus for cleaning and skimming debris on, about and below a surface of a body of water. The apparatus comprising a handle connected to a pole, a frame configured in a generally circular shape having a center point where the handle is attached to the frame. Attached to the frame is a mesh, in the shape of a net to collect debris from at or about the surface of the body of water. A float assembly comprising a float attachment rod and a float, that is attached to either the pole, the handle or the frame so that the center of the float is positioned at the center point of the frame at a collinear point along a central axis line that runs through the frame, the float, the handle and the pole.

17 Claims, 14 Drawing Sheets

BUOYANT SKIMMER APPARATUS

TECHNICAL FIELD

The present disclosure relates to a buoyant skimmer apparatus for cleaning and skimming floating debris on and below the surface of water. More particularly, the present disclosure relates to a skimming device that utilizes a central floatation assembly to support and enable 360° rotational and directional movement of a skimmer frame on, about and below the surface of pools, ponds and other bodies of water thereby facilitating effortless and efficient debris collection.

BACKGROUND

Swimming pools require regular, if not daily, cleaning and maintenance to ensure a safe and enjoyable swimming experience. Floating debris like leaves, insects, grass clippings, pollen, etc., that land on and then float on the water surface eventually sink to the bottom if not collected in a timely manner. Conventional pool cleaning devices all involve manual labor, which can be strenuous, time-consuming, labor-intensive, and inefficient. Automated pool cleaning systems have been developed to address these challenges, but they are expensive, typically designed for bottom and pool wall cleaning only and have limitations. Robotic surface cleaners, due to random travel patterns, weak batteries or lack of sun for solar power take hours to get debris collected, if at all. They often miss areas of the surface, the collection screen fills up or if using pool suction, it is often not sufficient. This ultimately results in the need to manually skim the surface quickly just prior to the pool's use.

Skimming devices like flat shallow net skimmers and deeper bagged leaf rakes are used to skim debris floating on the surface of swimming pools, ponds, and other water bodies. These devices attach to the end of standard pool cleaning poles that vary in length from 4 feet to 18 feet or more.

Manual skimming requires extreme effort to keep the skimmer collection net centered at the waterline while moving in different directions. The weight of the pole and skimmer when extended outward quickly becomes difficult for other than very strong operators and professional pool cleaning personnel. Skimming inground pools is difficult but free standing above ground pools have a unique issue due to their sidewalls being as high as 54 inches and present a unique challenge in trying to hold the pool pole extended over the edge from on the ground outside the pool perimeter. This is a cumbersome and time-consuming task for all types of pools and is often neglected by the pool owner between weekly professional or homeowner cleanings. Not keeping the pool clean causes unhealthy and often non swimmable conditions. Professional pool cleaning personnel who often clean 15-20 pools a day, deal with the same issues that over time often results in fatigue and injury.

One of the primary technical problems in the field of pool cleaning apparatuses is the lack of a manual pool skimmer that can be maneuvered in any direction at any moment without dealing with the weight of the pole and skimmer even when extended many feet out from the operator. Whether pushing the skimmer away from the operator towards the far side of the pool, moving laterally towards the left or right at any moment at any angle or flipping 180 degrees when bringing the skimmer back towards the operator, the frame and net need to rotate to accommodate the movement while the operator struggles to keep the skimmer centered at the waterline.

Further, conventional pool cleaning apparatuses do not allow easy maneuverability of the mesh net over the surface of the water and thus debris collection is not efficiently done, if done at all. Additionally, the longer the length of the pole connected to the skimmer the heavier it gets making it more difficult for the cleaning personnel to effectively clean the surface of the water. Furthermore, conventional pool cleaning apparatuses fail to provide any kind of float assisted 360° rotational movement of the pool cleaning apparatuses to facilitate effective pool cleaning. Prior attempts to add flotation typically sit flat on the water surface and do not address the need to use centrally located floatation to allow a skimmer frame to rotate in the water allowing for unlimited 360° rotation and directional control. Traditional pool skimmers require significant effort and manual labor to keep the net centered at the waterline and collecting debris effectively. Furthermore, existing devices lack assisted rotation capabilities and do not accommodate unlimited directional movement.

One of the key technical challenges is to maintain stability and control of a float assembly and—attached frame for effective debris collection. Another challenge is to design the apparatus and the attached pole in a way that allows for smooth and controlled 360° rotational movement.

In light of these challenges, there is a need for an innovative pool cleaning apparatus that offers improved cleaning performance, versatility, and user-friendly operation. Such an apparatus should be capable of efficiently collecting all surface debris and debris floating below the surface, thereby reducing the effort involved for pool cleaning while enhancing the overall pool maintenance experience.

Further limitations and disadvantages of conventional and traditional approaches will become apparent to one of skill in the art, through comparison of described systems with some aspects of the present disclosure, as set forth in the remainder of the present application and with reference to the drawings.

SUMMARY

According to embodiments illustrated herein, is an apparatus for cleaning and skimming debris on, about and below a surface of a body of water. The apparatus comprising a handle connected to a pole; a frame configured in a generally circular shape having a center point and wherein the handle is securely attached to the frame. A mesh, in the shape of a net to collect debris from the surface of the body of water attached to the frame. A float assembly comprising a float attachment rod and a float, that is attached to either the pole, the handle or the frame so that the float assembly comprising a float attachment rod and a float, that is attached to either the pole, the handle or the frame so that the center of the float is positioned at the center point of the frame. The float has a pivot point at a center of the float and the center of the float is positioned at the center point of the frame at a collinear point along a central axis line that runs through the frame, the float, the handle and the pole.

A general object is to provide a buoyant skimmer apparatus for collecting debris from the surface and sub surface of a body of water aided by a float positioned at a point in the center of the frame and positioned at a collinear point on a central axis line that passes through to the pool pole thus supporting rotational and directional movement of the skimmer along the pool's surface while relieving any need for the operator to exert any force to support the weight of the extended pole and attached skimmer to keep it centered at the waterline.

Another object of the present invention is to provide multiple ways of connecting a float to a skimmer by using existing handle types in the industry or pre-fabricating new handles for skimmer devices.

Still another object of the present invention is to eliminate the constant and strenuous upward force needed on the bottom of the pool pole to keep an otherwise heavy and sinking skimmer positioned at the waterline.

Still another object of the present invention is to provide a buoyant skimmer apparatus that allows the frame to remain centered at the waterline during use, enhancing maneuverability and coverage by providing an assembly that connects a float that is positioned at a point in the center of the skimmer frame and collinearly attached along a central axis to the skimmer's handle that can be securely connected along the same central axis to a pool pole, allowing for 360-degree rotation and axial movement of the apparatus.

Still a further object of the present invention is to provide an apparatus that is constructed using durable materials, such as blow-molded high-density polyethylene (HDPE) for the float and aircraft grade aluminum for other components.

Still another object of the present invention is to provide an apparatus that includes a float assembly that is securely attached to the handle using a rod attachment device and thumb screw to ensure stability and prevent detachment during operation while allowing for easy removal and reattachment of the float assembly for emptying the mesh net or to use the skimmer completely under water. Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF DRAWINGS

The accompanying drawings illustrate the various embodiments of systems, methods, and other aspects of the disclosure. Any person with ordinary skills in the art will appreciate that the illustrated element boundaries (e.g., boxes, groups of boxes, or other shapes) in the figures represent one example of the boundaries. In some examples, one element may be designed as multiple elements, or multiple elements may be designed as one element. In some examples, an element shown as an internal component of one element may be implemented as an external component in another, and vice versa. Further, the elements may not be drawn to scale.

Various embodiments will hereinafter be described in accordance with the appended drawings, which are provided to illustrate and not to limit the scope in any manner, wherein similar designations denote similar elements, and in which.

DETAILED DESCRIPTION

Figure 1:
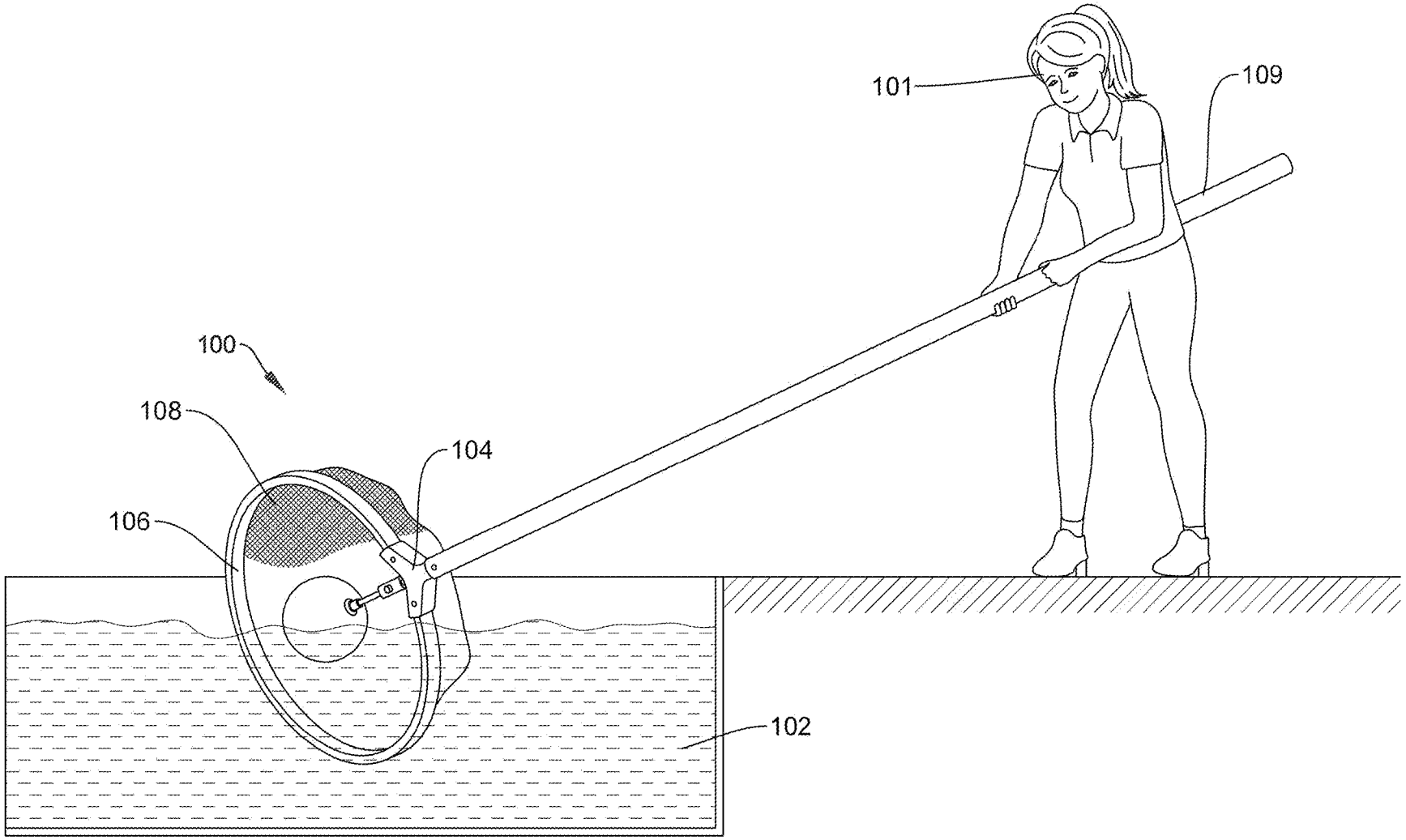
FIG. 1 illustrates a pool cleaning operator using the buoyant skimmer apparatus for cleaning debris from a swimming pool, according to one embodiment of the present disclosure.

The present disclosure may be best understood with reference to the detailed figures and description set forth herein. Various embodiments are discussed below with reference to the figures. However, those skilled in the art will readily appreciate that the detailed descriptions given herein with respect to the figures are simply for explanatory purposes as the methods and systems may extend beyond the described embodiments. For example, the teachings presented and the needs of a particular application may yield multiple alternative and suitable approaches to implement the functionality of any detail described herein. Therefore, any approach may extend beyond the particular implementation choices in the following embodiments described and shown.

References to "one embodiment," "at least one embodiment," "an embodiment," "one example," "an example," "for example," and so on indicate that the embodiment(s) or example(s) may include a particular feature, structure, characteristic, property, element, or limitation but that not every embodiment or example necessarily includes that particular feature, structure, characteristic, property, element, or limitation. Further, repeated use of the phrase "in an embodiment" does not necessarily refer to the same embodiment. All of the implementations described below are exemplary implementations provided to enable persons skilled in the art to make or use the embodiments of the disclosure and are not intended to limit the scope of the disclosure, which is defined by the claims.

Furthermore, there is no intention to be bound by any expressed or implied theory presented in the preceding technical field, background, brief summary of the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

The buoyant skimmer apparatus (100) is a floating surface skimmer with 360° of directional control. The buoyant skimmer apparatus eliminates most of the effort and strength needed to effectively skim the surface and sub-surface of floating debris such as leaves, insects, flower pedals, pollen, and the like from above ground pools, in ground pools, ponds and other bodies of water. The buoyant skimmer apparatus is designed to allow an operator's use of natural arm and hand movement while the skimmer stays perfectly at the waterline. This positioning of the skimmer frame is made possible by adding a single floatation element to the skimmer. The float's spherical center of rotation is positioned so that the float's center is positioned at the center point of the frame at a collinear point along a central axis line that runs through the float, the handle and the pole. To control direction and rotation of the frame in the water the pole becomes both the axis of rotation and direction for the float and thus the frame. The operator simply guides the open face of the net in any direction to collect floating debris at or around the surface of the water. The skimmer maintains the same width of debris collection and spacing between the float and frame regardless of what direction the skimmer is headed.

When the apparatus is attached to the pool pole with all elements of the device in collinear alignment with the pole, the pole becomes the axis of rotation and directional control of the skimmer. The float becomes the fulcrum which allows the axial motion of the pole to move in any angle in relation to the water such as up and down movement. The float also is the center of rotation, directional pivot point and stabilizing element that keeps the frame centered at the waterline regardless of its direction, angle of the pole or degree of the frame's rotation in the water. The disclosed apparatus eliminates the need for the operator's constant effort to apply upward force to the bottom of the pole to hold the skimmer frame and net at the waterline, thus allowing the operator to focus solely on guiding the skimmer to capture debris in any direction at any given moment.

By incorporating these components, the buoyant skimmer apparatus for cleaning a swimming pool disclosed herein offers a user-friendly and efficient solution for maintaining a clean, healthy and debris-free swimming pool. The detachable float assembly, secure handle attachment, and strategically positioned float enhance the maneuverability and functionality of the buoyant skimmer apparatus, allowing for effective debris collection and pool cleaning.

Now referring to the drawings, FIG. 1 illustrates an operator (101) positioning a buoyant skimmer apparatus (100) for cleaning and skimming debris at or about the surface of a water (102). The buoyant skimmer apparatus (100) comprises a handle (104) and a frame (106) configured to be fitted with a plastic snap on covering, wherein the handle (104) is securely attached to the frame (106), a water pervious mesh (108) configured in the shape of a net is attached to the frame (106) and the mesh (108) is a net to collect debris from the surface and sub-surface of the water (102). The buoyant skimmer apparatus (100) (shown in FIG. 2) further comprises a float assembly (110) comprising a float attachment rod (112) and a float (114) and a rod attachment device in this case notched transitional support member (118*a*). The rod attachment device connects the float attachment rod to the handle of the frame and thus the pole. The float assembly (110) is detachably and securely attached to the handle (104) with a thumb screw (116) and thus the frame with a rod attachment device and the float (114) is attached to a float attachment rod (112). The rod attachment device may be varied to accommodate different skimmer handles. It is significant to note that the rod attachment devices disclosed herein are different shapes and dimensions. In this embodiment the rod attachment device is a notched transitional support member (118*a*) which is inserted into the handle and removably connected to the float attachment rod.

In an embodiment, the float (114) is positioned at a collinear point in the center of the skimmer frame (106) along the central axis line passing centrally through the frame (106), handle (104) and pool pole (109) to support the frame (106) for 360° rotational and directional movement on or near the surface of the water (102). The addition of the float, rod, and attachment device only adds a minimal weight of 5-6 ounces over a traditional skimming device, ensuring that the apparatus remains lightweight and easy to lift out of the water, relocate to a new entry point, or empty the net. The float is positioned at or about the center of the frame and debris collection net, aligning the center of rotation of the float with the waterline when in the water. This placement and resulting pivot point enables the operator to rotate the half-submerged frame opening to always face in the desired direction of travel with a simple twist of the pole. The rounded shape of the float allows for equal and smooth rotation and movement of the skimmer in any direction; forward, back, lateral left and lateral right at any degree of rotation.

Conventional pool cleaning apparatus also known as skimmers have a frame, a net, a plastic cover over the net and frame, and a handle that attaches it to a pool pole. The disclosed buoyant skimmer apparatus 100 is comprised of float assembly (110), float attachment rod (112) made of an aircraft grade aluminum alloy and float (114) in a preferred embodiment, the float is configured in a spherical shape approximately 5.5 inches in diameter, blow molded from a durable high density polyethylene (HDPE) material or the like. The buoyant skimmer apparatus (100) is configured with a float (114) that is suspended at a point along the central axis line of the pole that positions the float at a collinear point in the center of the frame's collection net. The float is positioned at the central axis pivot point relative to the water in the center of the frame to allow the skimmer frame 360° rotation in the water. The float allows the skimmer net opening to face in any direction along the surface of the water with simple rotation of the attached pool pole. The positive buoyancy of the float keeps the skimmer at the waterline with no added operator effort. Without the float at the center of the frame the 360° rotation could not be accomplished without constant exertion of force on the bottom of the pole by the operator to keep the skimmer frame from sinking. The design of the instant disclosure ensures that the buoyant skimmer apparatus can effectively maneuver and clean the pool's surface in any direction throughout the surface of the swimming pool while eliminating the effort and strength needed to support the weight of the pole and skimmer at all times. Light to moderate lateral force is required on the left or right side of the pole to move the skimmer towards the left or right. Simple hand over hand feeding of the pole moves the skimmer away and towards the operator. Fractional coordinated twists of the pole keep the opening of the frame facing the direction of travel.

The float is securely and permanently attached to the float attachment rod and when inserted in the rod attachment device it is then secured to the handle with a ¼ turn of the thumb screw. The float is positioned precisely at a collinear point at or near the center of the net's frame that is on a common horizontal plane and central axis line A-A' passing centrally through and at collinear points to the float, frame, float rod, rod attachment device, handle and the attached pool pole that becomes the axis of movement and rotation for the skimmer. As a result, the float positioned at the end of the central axis provides the fulcrum, center of rotation, pivot point, and frame support attributes, all enabling 360° rotational and directional movement throughout the surface and sub-surface of the water while maintaining its float assisted position centered at the waterline.

Figure 2:
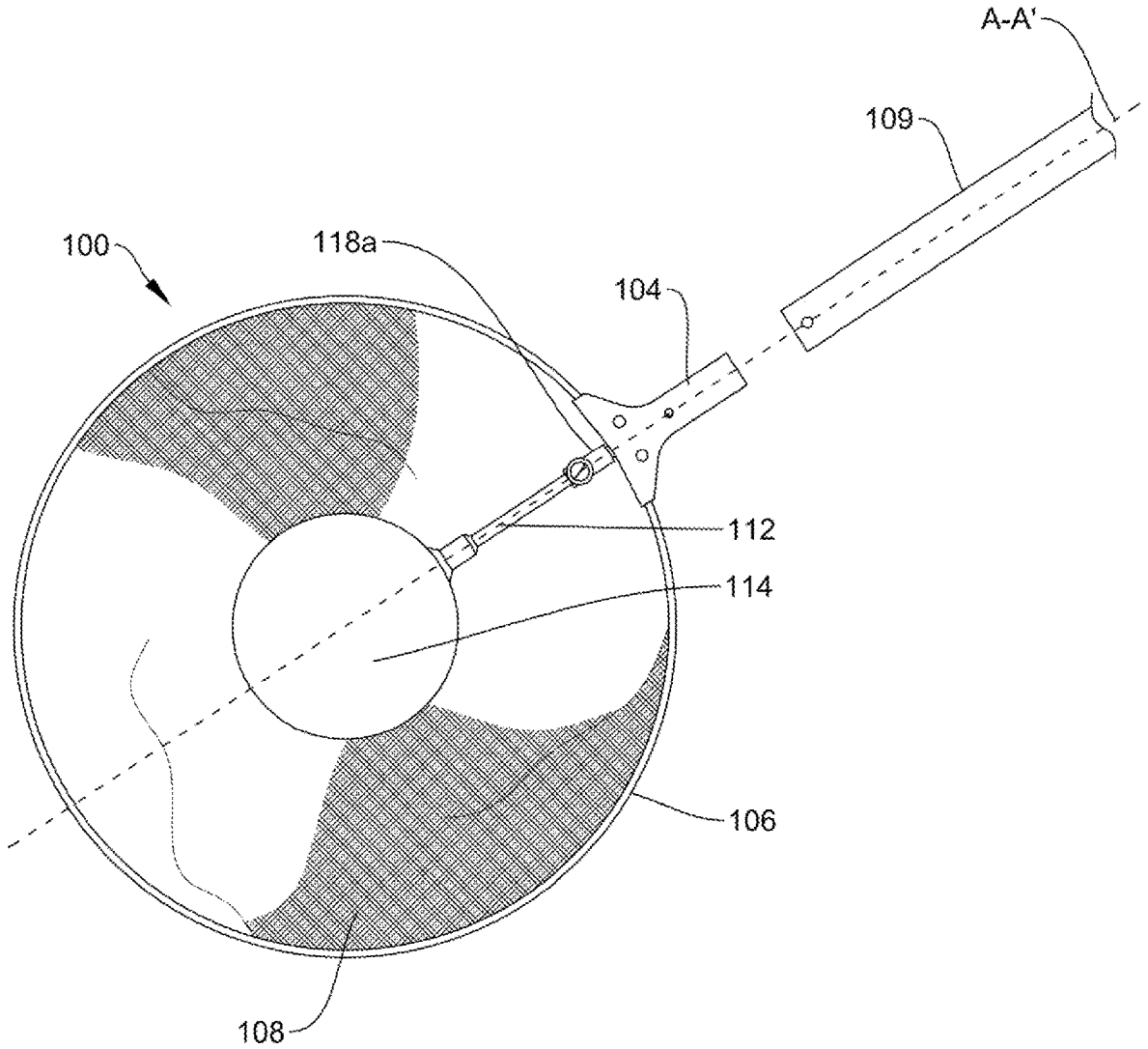
FIG. 2 illustrates a top view of the buoyant skimmer apparatus for cleaning debris from the swimming pool, according to one embodiment of the present disclosure.

FIG. 2 illustrates a top view of the apparatus for cleaning debris from the swimming pool, according to one embodiment of the present disclosure. The frame is specifically designed to be snap fitted with a covering. Such snap-fit mechanism allows for easy assembly and disassembly when replacing the net. The frame also shares collinear attachment points along a central axis line, ensuring coordinated movement and rotation during operation.

The frame securely holds a mesh net that collects and traps debris from the surface and sub-surface of the swimming pool. The mesh is attached to the frame with a plastic snap on cover made of HDPE. It also has a shape that aids in directing debris into the net and especially helpful getting debris floating up against the tiles around the perimeter of the pool. The mesh is constructed from a durable and fine material like nylon, polyester, vinyl, etc., that effectively captures debris while allowing water to pass through. The float assembly comprises a float attachment rod (112), a float (114) and rod attachment device which in this instance is a notched transitional support member (118*a*). The float attachment rod has a first end with a raised annular portion and internal threading, securely attaching the float to the rod.

The float has a center and wherein the float's center is positioned at the center point of the frame at a collinear point along a central axis line that runs through the float, the handle and the pole. The float is positioned at a point in the center of the frame (106) and collinear along a central axis line A-A' passing centrally through frame, handle and the pole providing buoyancy and a pivot point to support 360° rotational and directional movement of the frame on and through the pool's surface. Buoyancy levels must be calculated to assure support of the weight of the entire device and attached pool pole while allowing the frame and attached net to rotate 360° in the water with no restriction. Rotation is accomplished with a simple twist of the pool pole. The positive buoyancy factor of the float is based on the total weight of the apparatus including a weight of a pre-defined length of the pole and frame so that the buoyancy of the float maintains the frame at a half-submerged position on or about the surface of the water regardless of direction of travel and degree of rotation of the frame or angle of the pole to the water.

For this embodiment the float and frame are round, but shapes and sizes may vary for different embodiments. A spherical float that is sized properly to a round framed skimmer's weight and diameter results in maximum buoyancy and perfectly smooth rotation and movement centered on the water line.

The handle is detachably and securely connected to a pole. The pole is a standard pool pole used with any pool skimmer or pool maintenance device and in one embodiment it's comprised of a telescopic pole which allows the entire length of the device to be extended or retracted. The pole provides leverage to enable 360° rotational and directional movement of the apparatus, eliminating the need for the operator's constant and strenuous upward force on the bottom of the pole to keep the frame centered at the waterline while trying to navigate direction. The float ensures that the frame remains centered regardless of direction, angle of the pole or degree of rotation in the water.

The float is positioned at a point in the center of the frame and is generally spherical in shape. The float for this embodiment is made of blow-molded High-Density Polyethylene (HDPE), but it could be made from other materials which provide excellent buoyancy and durability properties. The positive buoyancy required to support the skimmer and pole is determined based on the weight of the entire apparatus, including the float weight and a predefined average weight of a standard 2 piece expandable 8-16 foot pool pole. Buoyancy must be calibrated to overcome the weight of the entire skimmer assembly and average pole to assure it will support the skimmer and pole at the waterline while allowing 360° rotation in the water.

To control direction in the water the pole becomes both the axis of rotation and direction for the float and frame. Further, the float is centered at a collinear point along the central axis line that positions it at or about the center of the frame and debris collection net and positions the center of rotation of the float at or about the waterline when in the water. The float becomes the pivot point around which the operator has the ability to rotate the half-submerged frame opening in the direction of travel with a simple twist of the pole. The rounded shape of the float allows smooth rotation and movement of the skimmer in any direction. The attached pole serves as the 360° axis of frame rotation and direction, while the float becomes the fulcrum, center of rotation and pivot point that keeps the frame centered at the waterline regardless of the frame's direction, angle to the water or degree of rotation in the water.

The float attachment rod features a female threaded protrusion at its first end, for securely and permanently attaching the float to the rod. The float is provided with a protrusion having male external threading, which securely attaches it to the first end of the float attachment rod. The float attachment rod's second end slides easily into the rod attachment device and is securely attached using the thumb screw. The rod attachment device is partially disposed inside the handle and positioned in between the two frame pieces, which is fixedly attached to the handle. The frame, float, float attachment rod, rod attachment device and handle are all positioned at collinear points along a central axis line, with the float serving as the pivot point in the center of the debris collection mesh and the attached pole now collinear with the float acting as the central axis of rotation. Rotation and directional control are achieved by aligning all components at collinear points, with the float positioned as a pivot point in the center of the debris collection net. The mesh (108) is to be used as a net that is sized and shaped to fit the perimeter of the frame (106). In an embodiment, the frame has an extruded U shaped plastic edge that is cut or molded to fit the required portion of the frame (106) and the net is mated to the frame (106) and the plastic edge is pressed over the netted frame.

The buoyancy of the float has to be sufficient to support the weight of the entire assembly, including the entire skimmer apparatus and an extended telescoping pool pole. The buoyancy of the float allows the frame and attached net to rotate 360° in the water without any restrictions, providing optimal functionality and maneuverability. The preferred embodiment of the invention utilizes a single flotation element positioned at or about the center of the debris collection frame and net. In the preferred embodiment, a durable plastic blow-molded sphere with a threaded protrusion serves as the float, accommodated by the attachment rod. Similar float materials, shapes, positions and sizes can be used in other embodiments.

Figure 3:
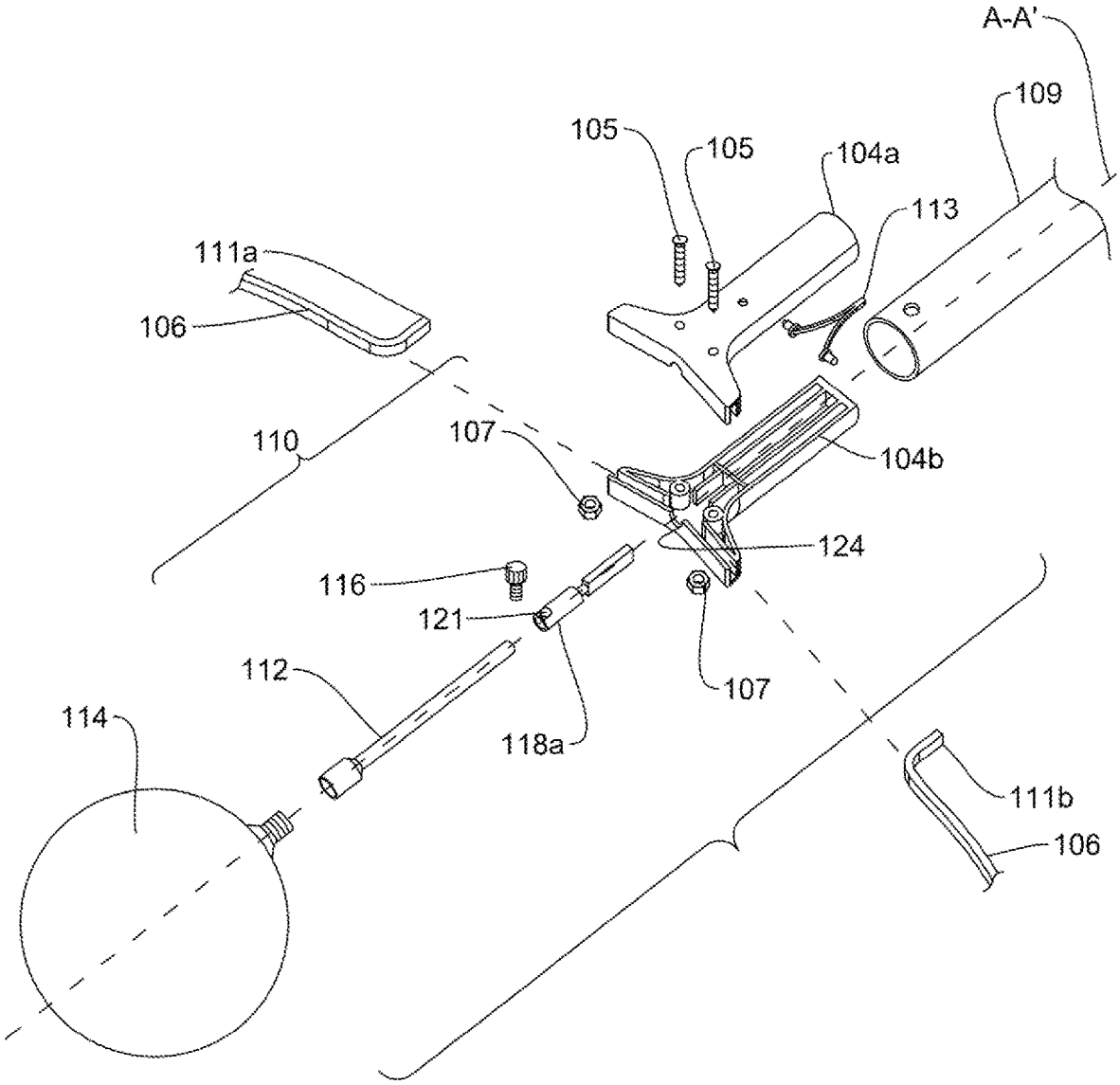
FIG. 3 illustrates an exploded view of the buoyant skimmer apparatus for cleaning debris from the swimming pool which includes the intermediate support member, according to one embodiment of the present disclosure.

FIG. 3 illustrates an exploded view of the buoyant skimmer apparatus for cleaning debris from the swimming pool. In this embodiment the float assembly is connected to the inside of the handle of the frame by using a notched transitional support member (118*a*) as a rod attachment device. It should be noted that there are many ways to attach the float assembly to a skimmer frame. In this embodiment the buoyant skimmer apparatus includes handle (104) (shown in FIG. 5) is comprised of a top portion (104*a*) and a bottom portion (104*b*), which are securely connected to each other using a plurality of attachment screws (105) and nuts (107). This construction allows for the notched transitional support member (118*a*) to be positioned and connected within the handle. The handle is further configured to removably connect to a pole (109) using a spring clip (113).

The buoyant skimmer apparatus for cleaning a swimming pool disclosed herein comprises several components that work together to effectively collect floating debris from the pool's surface and depths near the surface. The buoyant skimmer apparatus is designed to be easy to use and provide efficient cleaning performance. The handle is securely attached to the frame, which serves as the main connecting structure of the apparatus. The frame is designed to be snap fitted with a covering, providing additional protection and support to the buoyant skimmer apparatus and a sharp edge to collect debris at the waterline around the perimeter of the pool. Attached to the frame is a mesh material in the shape of the net, which is responsible for collecting floating debris from a swimming pool. The mesh is carefully designed and positioned to efficiently trap various types and sizes of debris, including leaves, twigs, and other floating particles.

Figure 4A:
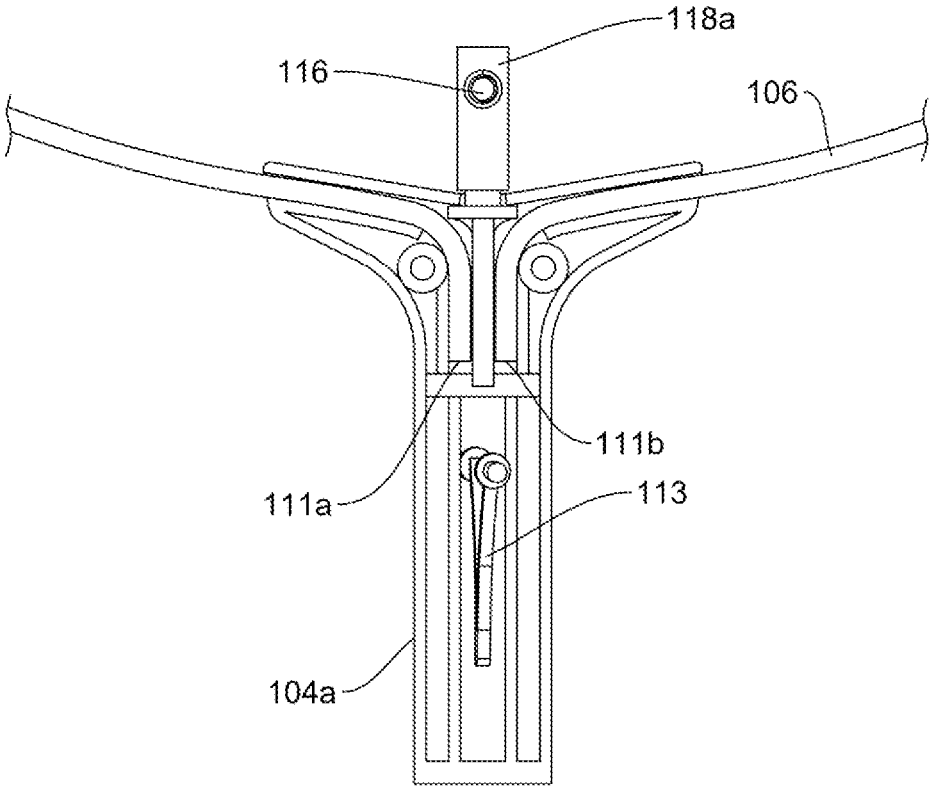
FIG. 4A illustrates a top view of the handle of the buoyant skimmer apparatus, according to one embodiment of the present disclosure.
Figure 4B:
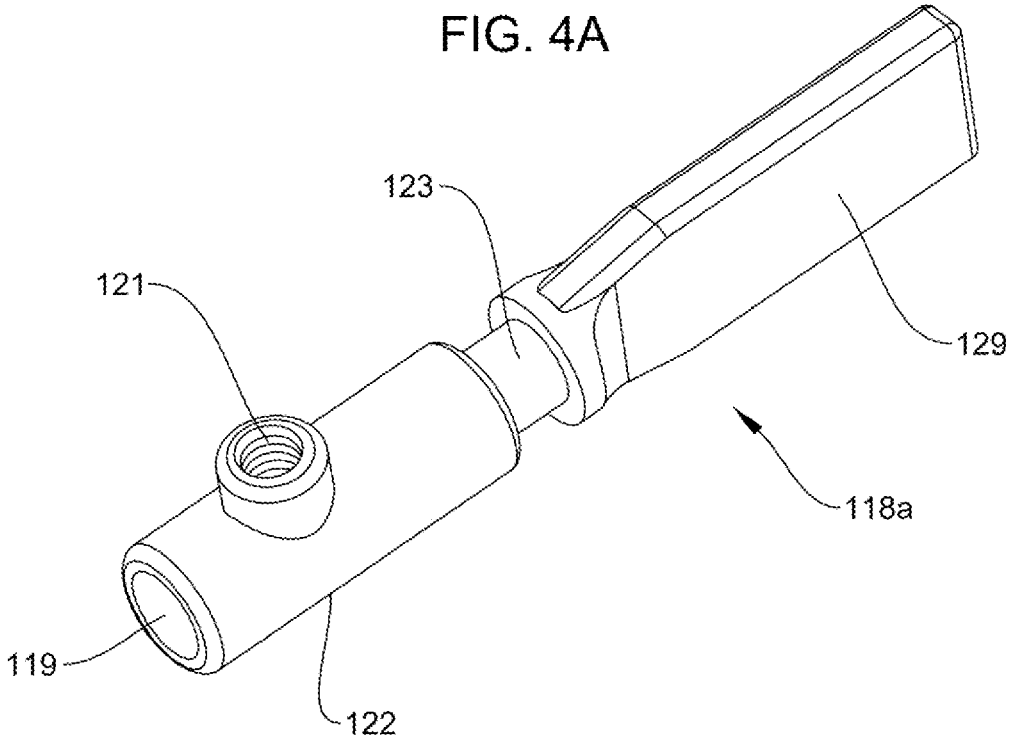
FIG. 4B illustrates a perspective view of a notched transitional support member, according to one of the embodiments of the present disclosure.

FIG. 4A illustrates a top view of the bottom portion (104*b*) of handle (104) showing the frame and the notched transitional support member positioned prior to top portion (104*a*) being attached, according to one embodiment of the present disclosure. The float assembly is securely attached to the handle using notched transitional support member (118*a*) as a rod attachment device. Notched transitional support member (118*a*) comprises a first portion and a second portion separated by a notch (123) (as shown in FIG. 4B). The second portion has a substantially rectangular profile (129) and is securely attached to the handle by positioning the rectangular profile within the handle. The first and second portions of the transitional support member are offset by a notch (123) which fits securely between a top portion (104*a*) and a bottom portion (104*b*) of the handle and lines up with the opening in the handle that is defined by half circle cutouts (124) in each handle portion which form the opening in the handle when the handle parts are secured together.

In an embodiment, the frame (106) which is made of aluminum is generally a circular shape (shown in FIG. 2) having two leg ends (111*a* and 111*b*), that are connecting points that are configured to be inserted into the handle between top portion (104*a*) and a bottom portion (104*b*) on each side of the rectangular profile (129) of the transitional support member. Handle (104) allows for attachment of the float assembly (110) for at least one of the embodiments by insertion of the frame leg ends (111*a* and 111*b*) into the handle (104). The two legs of the frame (106) are positioned into the bottom portion (104*b*) of handle (104) and the top portion (104*a*) is placed over the bottom portion (104*b*). The required screws and nuts are used to secure the frame legs and rod attachment device within the handle. Further, an appropriately sized float (114) is attached to the float attachment rod (112) and the float assembly (110) is inserted to the handle (104) using the rod receiving opening (119) in the notched transitional support member (118*a*) and the handle (104) is further securely and detachably connected to a pole when in use. In an embodiment, the frame (106), the float (114), the float attachment rod (112), and the handle (104) are all positioned at collinear points along a central axis line with the float (114) positioned at a point in the center of the debris collection frame (106) and mesh (108). In an embodiment, the float attachment rod (112) comprises a first end having a raised annular portion and having internal threading which securely attaches the float (114) to the first end of the float attachment rod (112). Further, the float (114) is provided with a protrusion with external threading that securely attaches the float (114) to the first end of the float attachment rod (112).

FIG. 4B illustrates a perspective view of notched transitional support member (118*a*), a notched rod attachment device according to one of the embodiments of the present disclosure. In this embodiment, notched transitional support member (118*a*) comprises of a first portion and a second portion, wherein the first portion has an annular profile (122) configured to receive float attachment rod (112). The annular profile (122) is configured with rod receiving opening (119) to receive float attachment rod (112) and a screw opening (121) featuring internal threading to receive a thumb screw (116) used to removably secure a float attachment rod (112) positioned within rod receiving opening (119) and below screw opening (121). The notched transitional support member (118*a*) has a second portion having a substantially rectangular profile (129) that fits inside the handle (104) in between the frame leg ends so that the float assembly is fixedly attached to the handle (104). The first and second portions of the notched transitional support member (118*a*) are offset by notch (123) which fits securely between the top portion (104*a*) and a bottom portion (104*b*) of the handle and lines up with the handle opening that is defined by half circle cutouts (124) (shown in FIG. 3) in each handle portion which form the opening in the handle that receives notch (123) when the handle parts are secured together locking all components within the handle (104).

Figure 5:
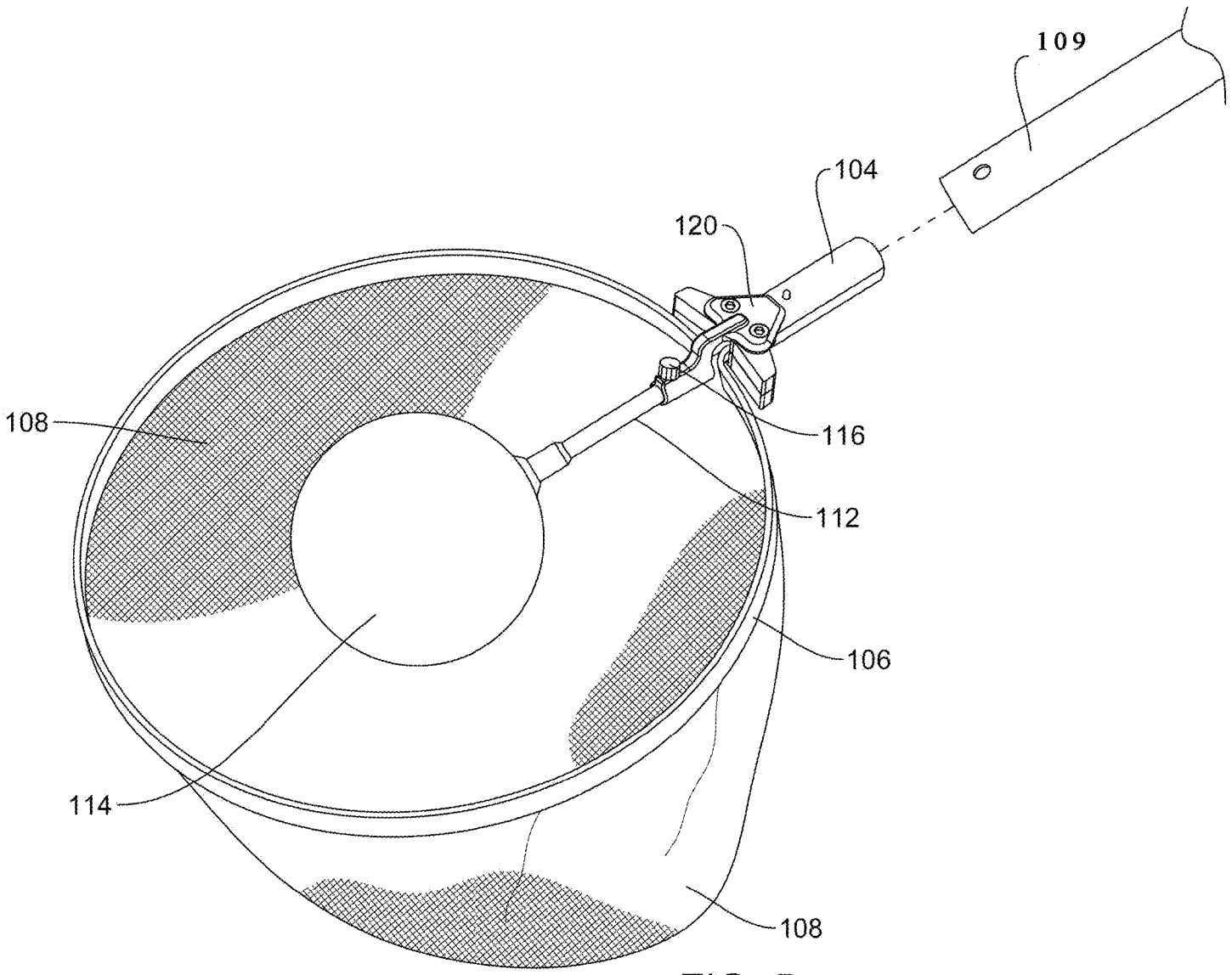
FIG. 5 illustrates an isometric view of the buoyant skimmer apparatus, according to one embodiment of the present disclosure.

FIG. 5 illustrates an isometric view of the buoyant skimmer apparatus, according to one embodiment of the present disclosure showing the float attachment rod (112) connected to the handle by a handle attachment mount (120) as the rod attachment device. This method of attachment can be accomplished with existing Y-shaped or "fishtail shaped" skimmer handles that are commonly used in the manufacture of many traditional pool skimmers.

Figure 6:
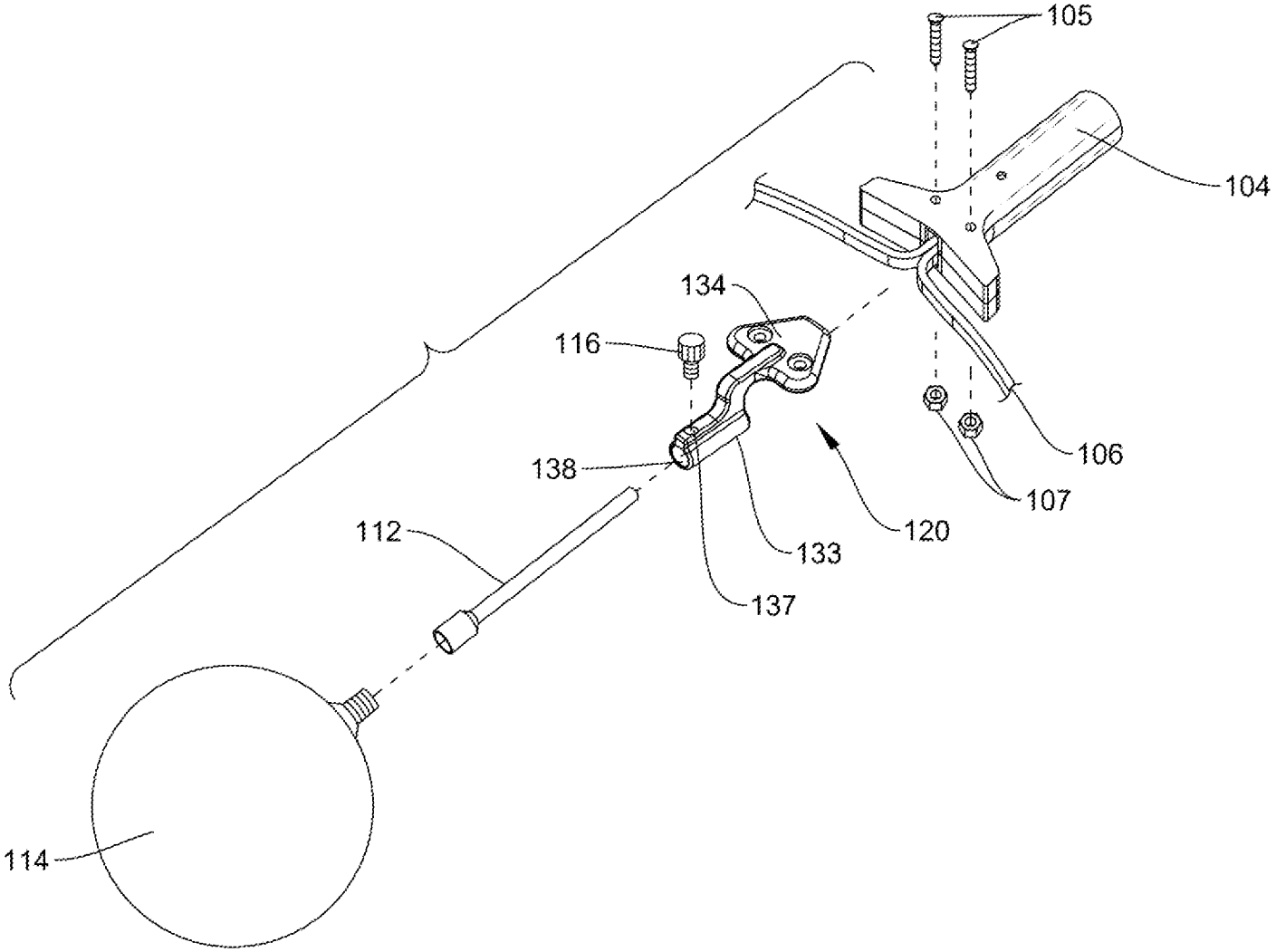
FIG. 6 illustrates an exploded view of the buoyant skimmer apparatus for cleaning debris from the swimming pool which includes the transitional support member, according to one of the embodiment of the present disclosure.

FIG. 6 illustrates an exploded view of the buoyant skimmer apparatus for cleaning debris at or near the surface of the water of a swimming pool which includes handle attachment mount (120) having a generally triangular shape with an offset attachment means for the float attachment rod according to one embodiment of the present disclosure. In an embodiment, the handle attachment mount (120) comprises a first annular portion (133) and a second triangular portion (134). First annular portion (133) has an annular opening (138) configured to receive the float attachment rod (112) and thumb screw opening (137) to insert a thumb screw (116) to securely attach and arrest movement of the float attachment rod (112).

Figure 7:
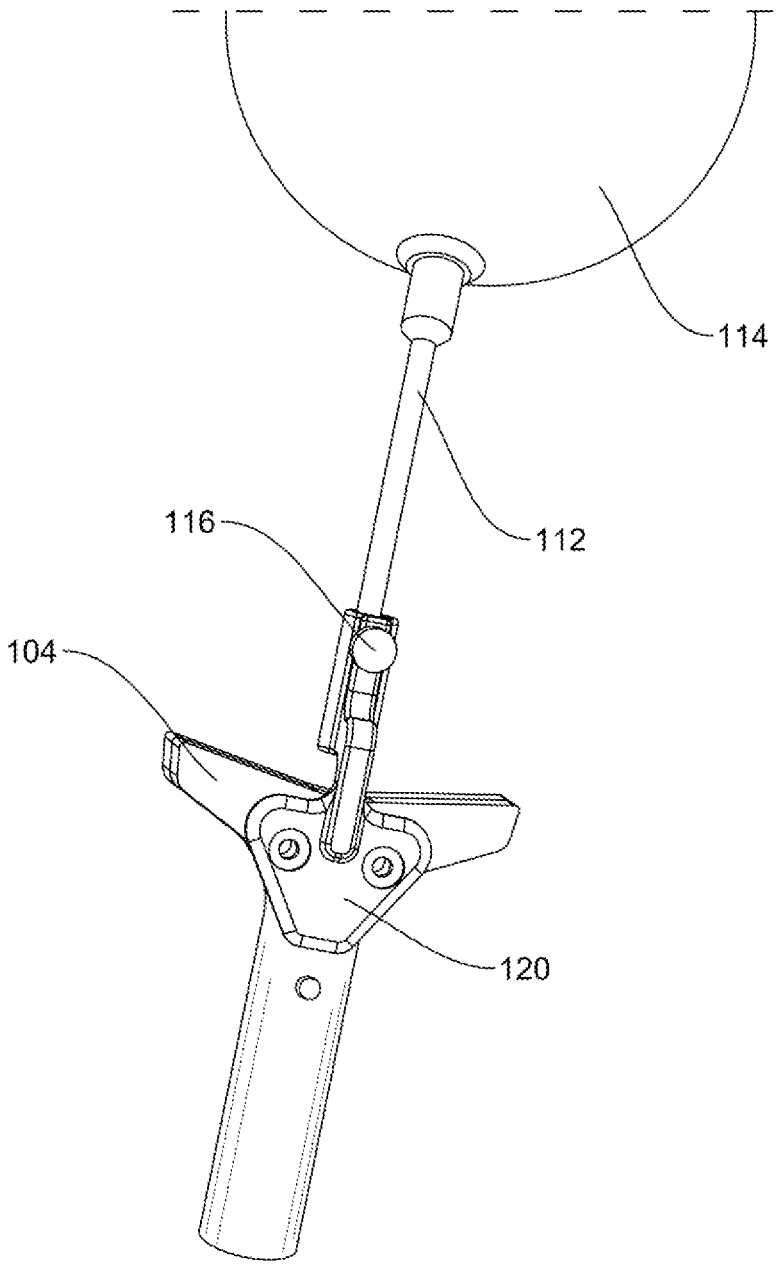
FIG. 7 illustrates connection of the handle, the transitional support member and the float rod and the float, according to one embodiment of the present disclosure.

FIG. 7 illustrates connection of the handle (104), the handle attachment mount (120), the float attachment rod (112) and the float (114), according to one embodiment of the present disclosure. In this embodiment, second triangular portion (134) has a substantially triangular profile shape that mirrors existing pool skimmer handles and having a plurality of screw openings to securely attach the handle attachment mount (120) to the handle (104) using a plurality of screws and nuts, and the first portion and the second portion are offset and parallel to each other so as to position the float assembly to have a common central axis line B-B' with the pole and float. One skilled in the art would understand that most existing Y-shaped handles have 27 mm spacing between the two attachment screws (105) and so in a preferred embodiment the handle attachment mount is configured with openings to align with the existing screw openings of the handle for easy attachment using existing skimmer handles.

The float rod is secured to the skimmer handle by a rod attachment device that is unique to each type of handle and frame. For this embodiment it is a handle attachment mount (120) that is the rod attachment device. The rod and float are held firmly in place with a thumb screw for easily securing and removing the float assembly. The float is easily removed with a ¼ turn of the thumb screw releasing the rod and float. Removing it during heavy cleaning may make emptying easier. During light cleaning the contents are easily emptied by holding the bottom of the net and with a shaking motion the contents will come out with the float in place. Additionally, the skimmer with the float removed is perfect for going back in the water to get any remaining debris floating below the water surface and out of reach with the float attached. In this embodiment, the net is configured with a 250 square inch opening.

Figure 8A:
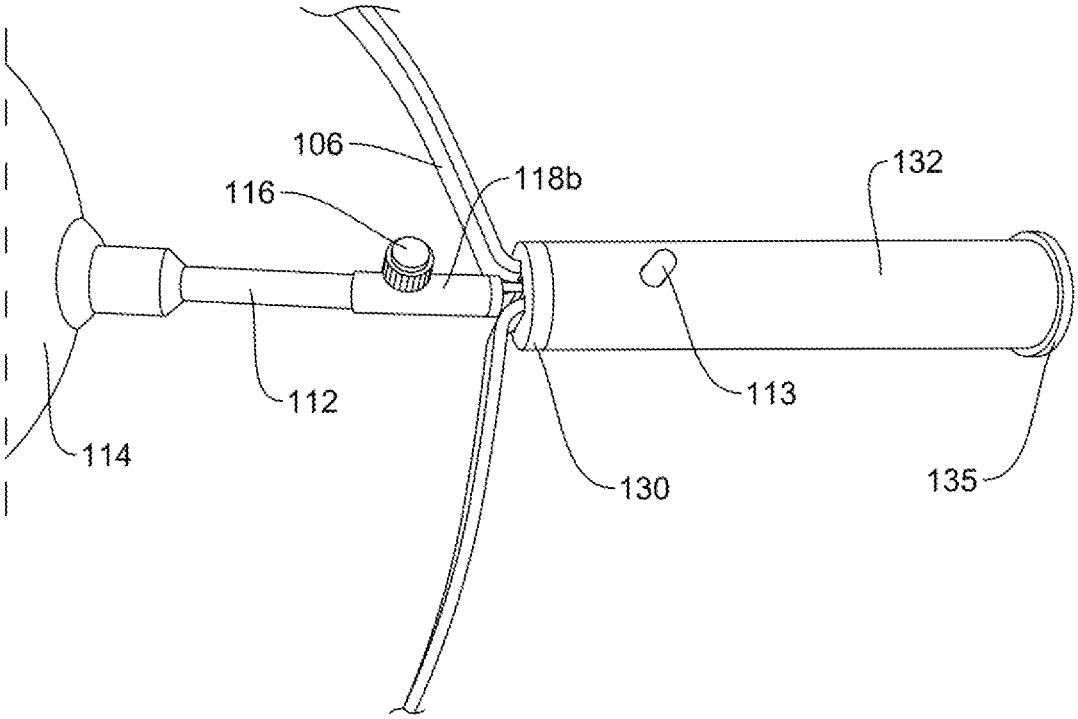
FIG. 8A illustrates connection of the handle, the transitional support insert, the rod attachment device, the float rod and the float, according to one of the embodiments of the present disclosure.
Figure 8B:
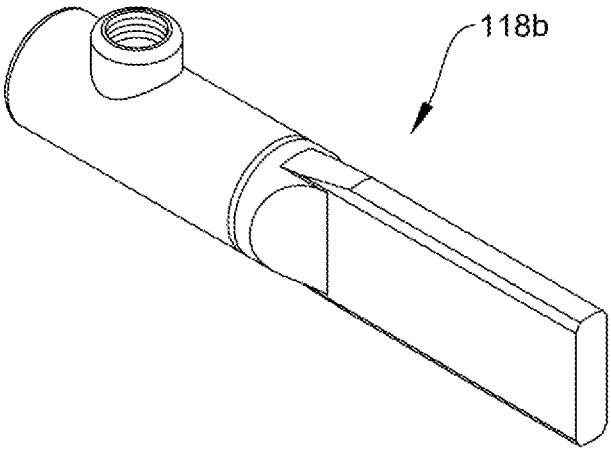
FIG. 8B illustrates a perspective view of a rod attachment device, according to one of the embodiments of the present disclosure.

FIG. 8A illustrates how float assembly (110) is detachably and securely attached to the alternative tube handle (132) using transitional support insert (130) with, transitional support member (118*b*) as the rod attachment device to connect to the float attachment rod (112) and to float (114) according to one embodiment of the present disclosure. FIG. 8B illustrates a perspective view of the transitional support member (118*b*). Transitional support member (118*b*) differs from notched transitional support member (118*a*) (shown in FIG. 4B) in that it lacks the notch (123) that is configured to marry with the handle (104). In this instance the connection takes place within the transitional support insert (130) and there is no need for notch (123).

Figure 9:
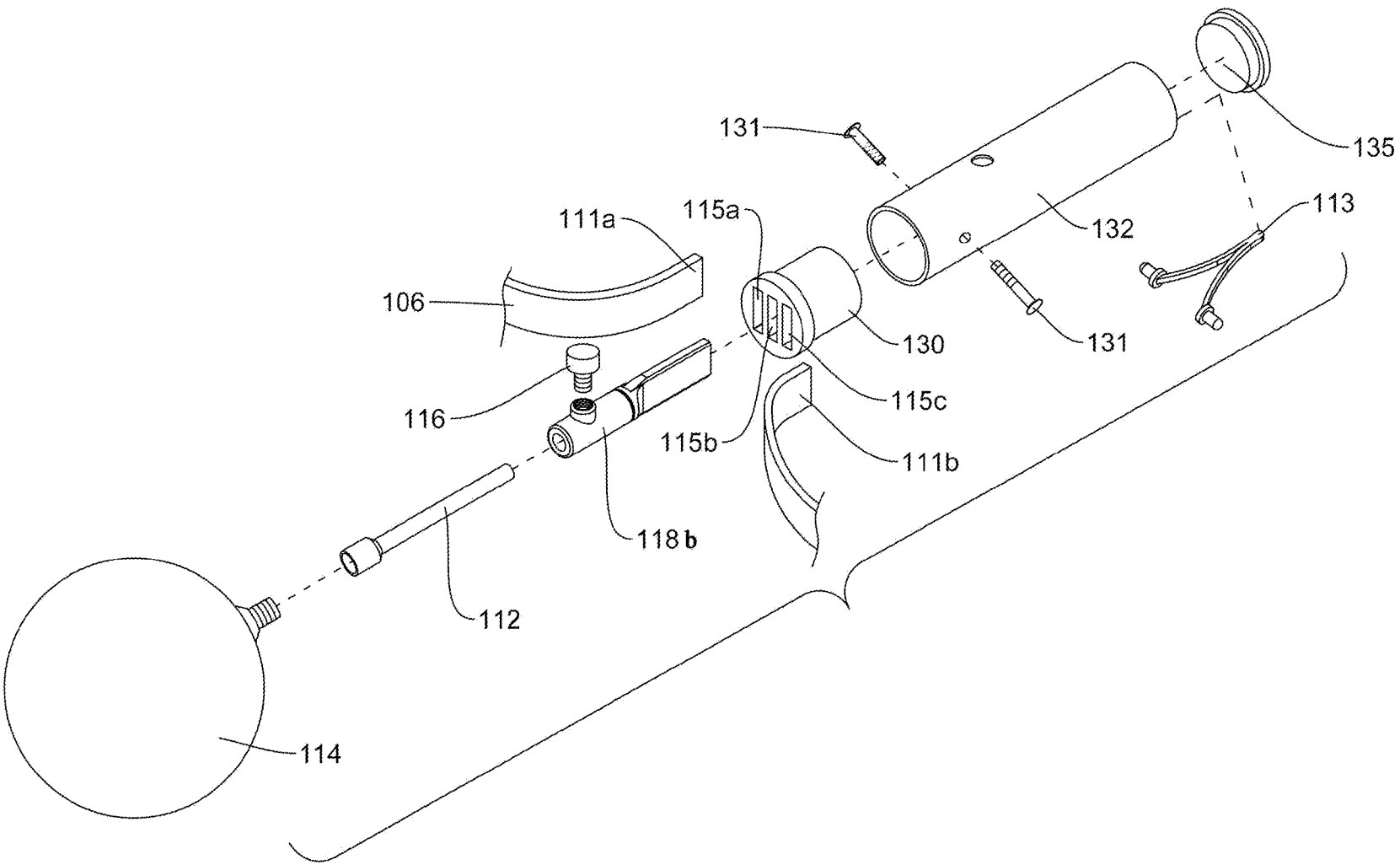
FIG. 9 illustrates an exploded view of the buoyant skimmer apparatus for cleaning debris from the swimming pool which includes the transitional support member having three rectangular slots, according to one of the embodiments of the present disclosure.

FIG. 9 illustrates an exploded view of the buoyant skimmer apparatus for cleaning debris from the swimming pool which includes the transitional support insert (130) having three rectangular slots, according to one embodiment of the present disclosure. In an embodiment, the transitional support insert (130) comprises a cylindrical insert having three rectangular slots on its face through to the rear. The two outer rectangular slots are configured to support the frame (106) by inserting leg end (111*a*) into right outer slot (115*a*) and leg end (111*b*) into left outer slot (115*c*) respectively. A central slot (115*b*) is configured to receive the transitional support member (118*b*).

Transitional support insert (130) is inserted into alternative tube handle (132) which is securely attached using rivets (131) and the alternative tube handle end is protected using end cap (135). Rivets (131) that lock the tube, frame legs and rod attachment device together can be any means of securely attaching such as screws, pop rivets, or "Chicago" screws. Alternative tube handle (132) is inserted and removably connected to conventional skimmer pole by using spring clip (113).

Figure 10A:
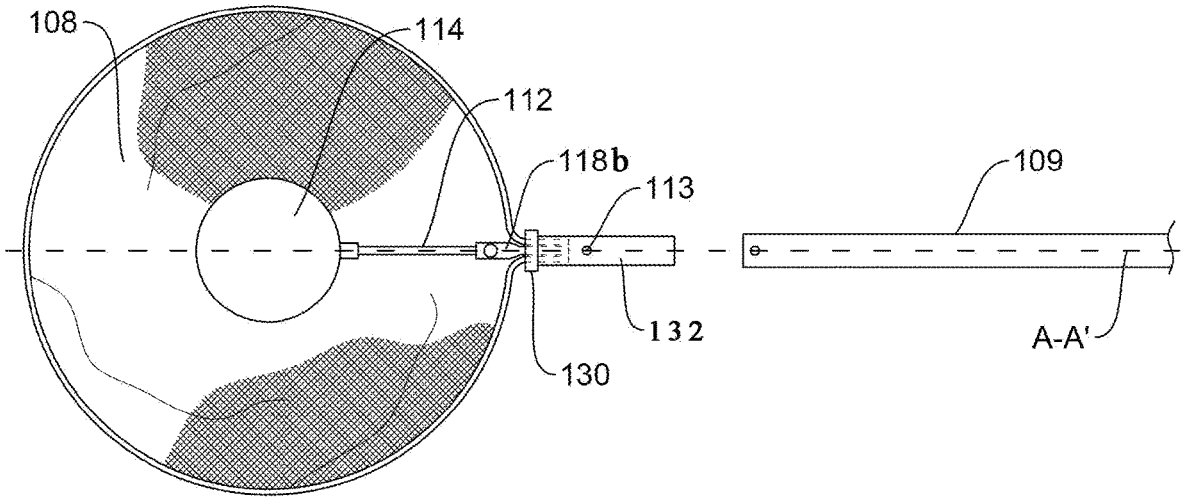
FIG. 10A illustrates a top view of the buoyant skimmer apparatus comprising a transitional support insert having three rectangular slots and the frame aligned to connect with the standard swimming pool pole, according to one embodiment of the present disclosure.

FIG. 10A illustrates a top view of the buoyant skimmer apparatus comprising the transitional support insert (130) having three rectangular slots and the frame aligned to connect with the standard swimming pool pole, according to one embodiment of the present disclosure.

Figure 10B:
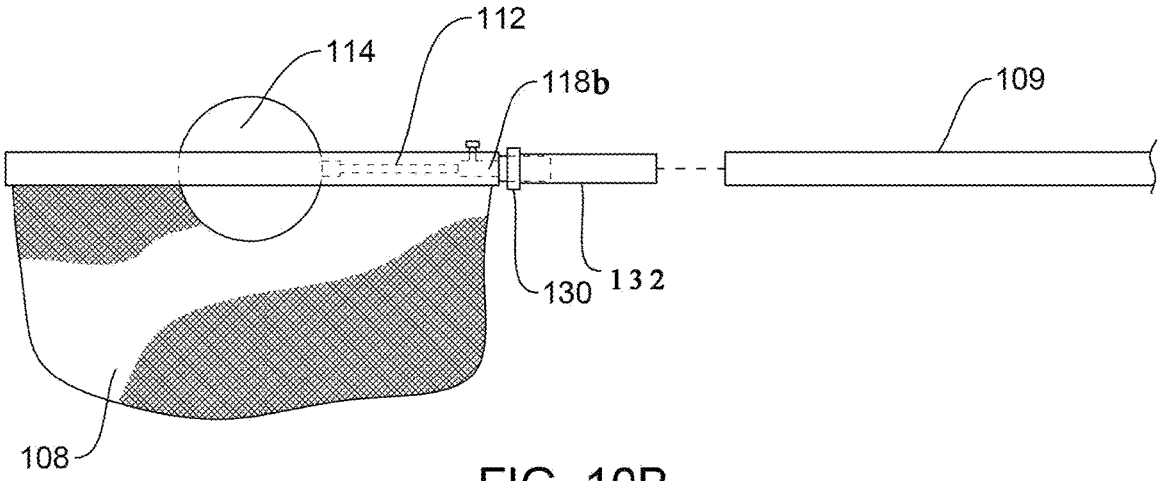
FIG. 10B illustrates a side view of the buoyant skimmer apparatus comprising the transitional support insert positioned within an alternative tube handle aligned with a pole, according to one of the embodiments of the present disclosure.
Figure 10C:
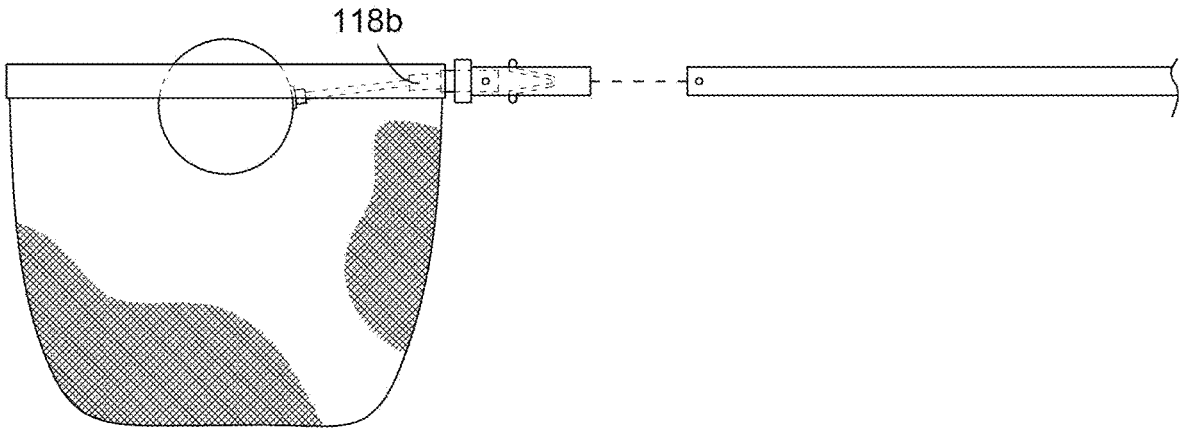
FIG. 10C illustrates a side view of the buoyant skimmer apparatus using an alternative float rod attachment device according to one of the embodiments of the present disclosure.
Figure 10D:
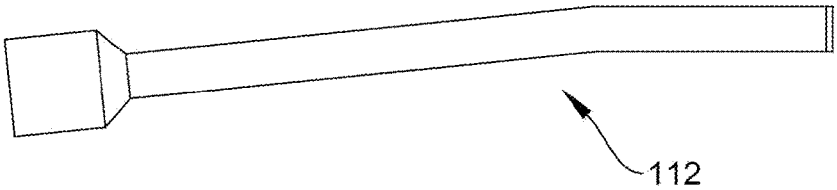
FIG. 10D illustrates a side view of an alternative float attachment rod, according to one of the embodiments of the present disclosure.

FIG. 10B illustrates a side view of the buoyant skimmer apparatus comprising the transitional support insert (130) positioned within an alternative tube handle aligned with a pole, according to one of the embodiments of the present disclosure. In this embodiment, the transitional support insert (130) receives the transitional support member (118*b*) to connect and align the float assembly in the center of the frame (106). As illustrated in FIG. 10B the float is positioned in the center of the frame with an attachment rod. The rod is secured to the skimmer handle by a rod attachment device that is unique to each type of handle. For this embodiment alternative tube handle (132) is inserted into a conventional pool skimmer pole and removably connected to the pool pole by using a spring clip (113). The rod and float are held firmly in place with a thumb screw that is part of the rod attachment device. The float is easily removed with a ¼ turn of the thumb screw releasing the rod and float. This is convenient when emptying a fairly full net as well as using the skimmer below the water surface to capture any submerged and floating debris after surface cleaning. FIG. 10C illustrates a side view of the buoyant skimmer apparatus comprising an alternative transitional support member according to one of the embodiments of the present disclosure. The float size, positioning and rod length will vary based on the size, shape and weight of the specific skimmer. The float's vertical/height relative to the size of the frame and float buoyancy factor may require pre manufacturing adjustment. In some embodiments the rod attachment device may require a slight angle that positions the float at an adjusted depth within the frame. FIG. 10C illustrates an embodiment of an alternative transitional support member (118*b*) shown in FIG. 10E having slight angle bend so that it positions the float at an alternative height within the frame (106). FIG. 10D illustrates a side view of an alternative float attachment rod (112), according to one of the embodiments of the present disclosure. The alternative float attachment rod depicted has a slight bend of about 8° from center so that it positions the float at an alternative height within the frame (106) from using a support member (118*b*) with no offsetting angle. The float attachment rod or the rod attachment device can have a slight downward angle from 2° to 10° from center so that it positions the float at an alternative operational height within the frame to assure optimal operation. This alternative angle of the a float attachment rod or the rod attachment device is used to calibrate or fine-tune the positioning of the float to make up for lengths and weights of poles and frames outside the standard used in the industry.

Figure 10E:
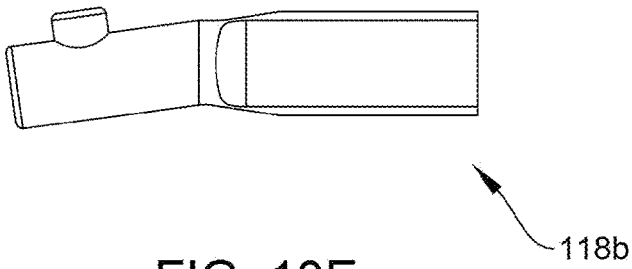
FIG. 10E illustrates a perspective view of an alternative rod attachment device, according to one of the embodiments of the present disclosure.

FIG. 10E illustrates a side view of an alternative transitional support member (118*b*), according to one of the embodiments of the present disclosure. The alternative transitional support member (118*b*) depicted in FIG. 10E has a slight bend at about 8° from center so that it can position the float height at an adjusted level into the center of the frame. The length and angle of the rod attachment device or float attachment rod may be varied to accommodate different handles and frames. In this configuration a standard float rod is used. It is significant to note that the buoyant skimmer apparatus (100) is scalable, such that different shapes and dimensions of the individual parts of the float assembly (110) may be used to accomplish aligning the float with the frame and the pole to place the float in the best operational position within the frame.

Figure 11:
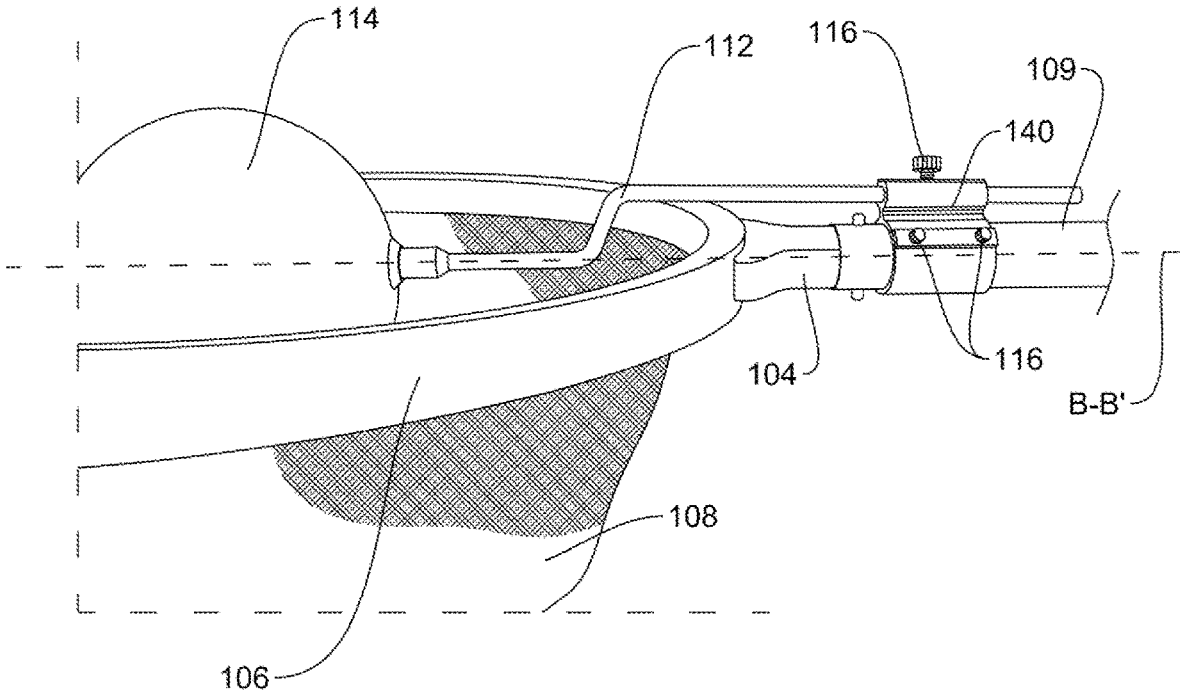
FIG. 11 illustrates a perspective side view of the buoyant skimmer apparatus connected to a pole using a pole attachment bracket, according to one of the embodiments of the present disclosure.

FIG. 11 illustrates a perspective side view of the buoyant skimmer apparatus connected to a pole using pole attachment bracket (140). In this embodiment because the bracket is attached to the pole and the float attachment rod needs to be offset to properly align the float within the frame. In this instance the float attachment rod (112) is a generally Z-shaped rod with 45° offsetting angles so as to position the float assembly and to have a common central axis B-B' with the pole.

Figure 12:
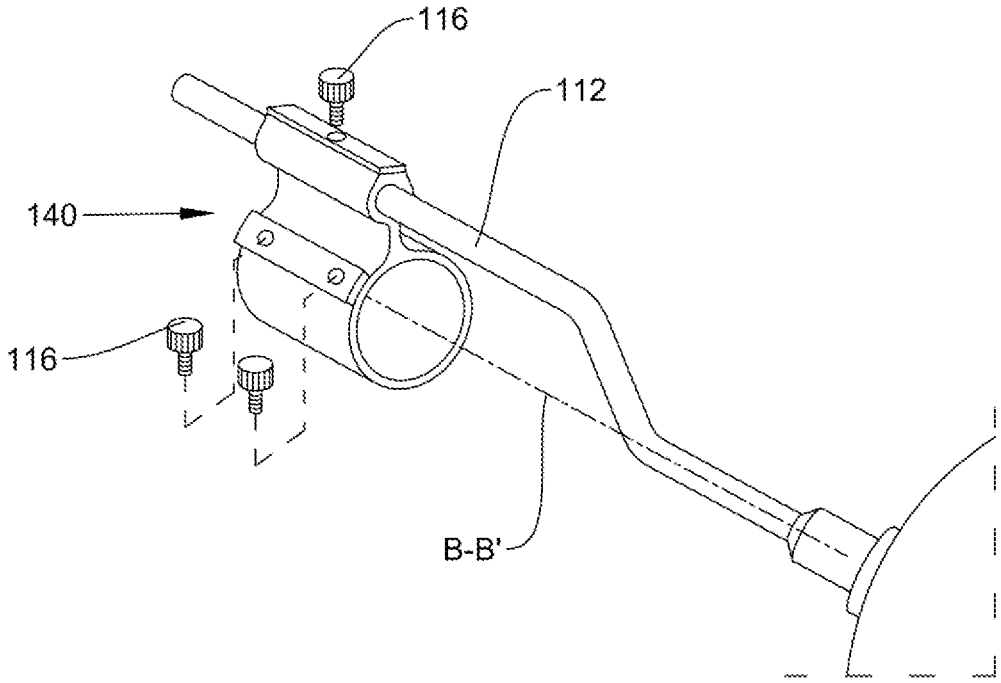
FIG. 12 illustrates a perspective view of a pole attachment bracket and float assembly, according to one embodiment of the present disclosure.

FIG. 12 illustrates a perspective view of a pole attachment bracket and float assembly, according to one embodiment of the present disclosure. It should be readily apparent to someone skilled in the art that any conventional pool skimmer designed with an appropriate sized and shaped frame and float can be retrofitted as a buoyant skimmer apparatus by mounting the float assembly on the pole by using the pole attachment bracket (140).

FIG. 13A-H illustrates a pictorial representation of a series of movements that include forward, backward and rotational movement of how the buoyant skimmer apparatus is able to move on the surface of the water and rotate a full 360°, according to one embodiment of the present disclosure. Present disclosure of the buoyant skimmer apparatus allows a pool skimmer to be maneuvered in any direction at any moment without dealing with the weight of the pole and skimmer even when extended many feet out from the operator. Whether pushing the skimmer away from the operator towards the far side of the pool, moving laterally towards the left or right at any moment or at any angle or flipping 180° quickly when bringing the skimmer back towards the operator, the frame and net are able to rotate to accommodate the movement while staying centered on the waterline. The present invention makes all these natural motions possible without the strength and exertion needed to physically support the exaggerated weight caused by the length of the pole and skimmer. Because the float is positioned at a point in the center of the frame and net the operator simply needs to keep the opening of the net facing the direction of travel with simple and fractional rotation of the pole and hand over hand push or pull movement of the pole. The buoyant skimmer apparatus compared to any conventional skimmer represents a vast improvement by affording the operator a fast, efficient and much less strenuous way to keep their pool free of floating debris that would otherwise end up on the bottom of the pool resulting in incomplete cleaning, suboptimal water quality, lost use of the pool all resulting in the need for more extreme cleaning efforts.

It is important to note that even though FIGS. 13A through 13H depict motion in a specific order, any move needed in any direction can be performed by the operator at any time as fast or slow as they want to move. The operator performs push and pull movement extending or retracting the pole with easy hand over hand movement. Lateral left or lateral right movement of the skimmer is performed by exerting force on the pole with either hand towards the desired direction of travel while allowing the trailing hand to act as the fulcrum for the movement. Simple and intuitive rotation of the frame allows the operator to keep the open area of the net facing the direction of movement. Rotation can be performed by either hand depending of direction of travel. These rotations are very small and become a naturally coordinated move. A full and quick move to the left would only take a 90° ¼ revolution counterclockwise twist at the same time lateral force is applied to the right side of the pole. Flipping the skimmer in the water immediately at the end of a push to continue skimming while pulling the pole back towards the operator simply requires a 180° flip of the pole at the same time the operator transitions from push to pull. Throughout all moves and changes of direction the skimmer stays at the waterline collecting debris. It is important to note that anyone skilled in the art would understand the force needed to move the skimmer frame in any direction. Pool owners and pool cleaning professionals will immediately understand the value in the disclosed buoyant skimming apparatus.

Figure 13E:
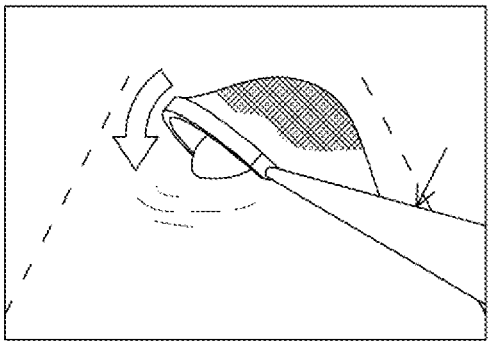
FIG. 13E illustrates a rotational position of the skimmer frame to about a 135° angle in reference to the starting position illustrated in FIG. 13A, according to an embodiment of the present disclosure.
Figure 13D:
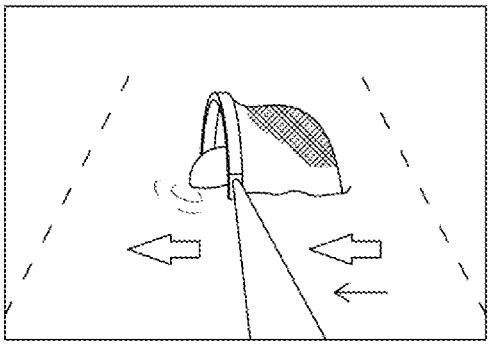
FIG. 13D illustrates a rotational position of the skimmer frame to about a full left 90° angle in reference to the starting position illustrated in FIG. 13A, according to an embodiment of the present disclosure.
Figure 13F:
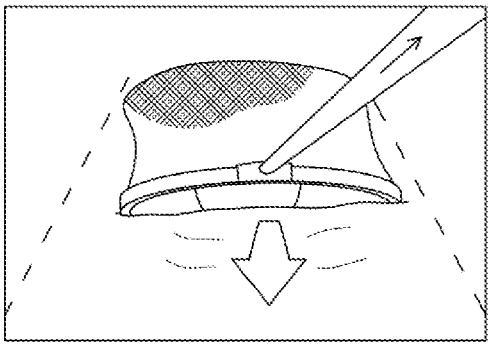
FIG. 13F illustrates a rotational position of the skimmer frame flipped to about a full 180° angle in reference to the starting position illustrated in FIG. 13A, according to an embodiment of the present disclosure.
Figure 13C:
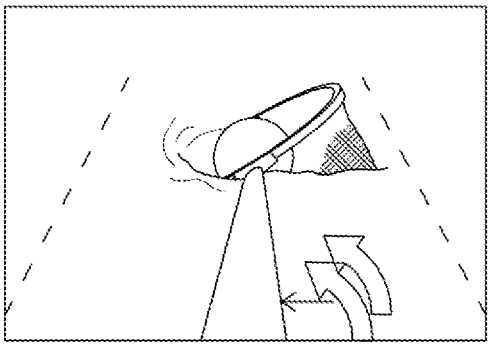
FIG. 13C depicts a rotational position of the skimmer frame to about a 45° angle in reference to the starting position illustrated in FIG. 13A, according to an embodiment of the present disclosure.
Figure 13G:
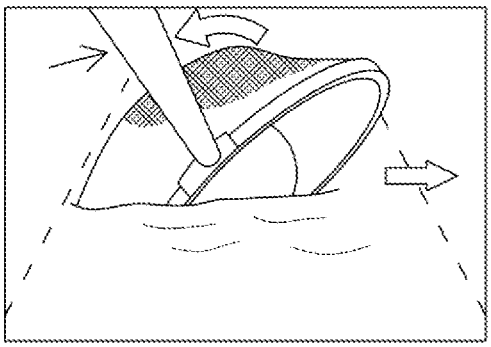
FIG. 13G illustrates a rotational position of the skimmer frame to about a 225° angle in reference to the starting position illustrated in FIG. 13A, according to an embodiment of the present disclosure.
Figure 13B:
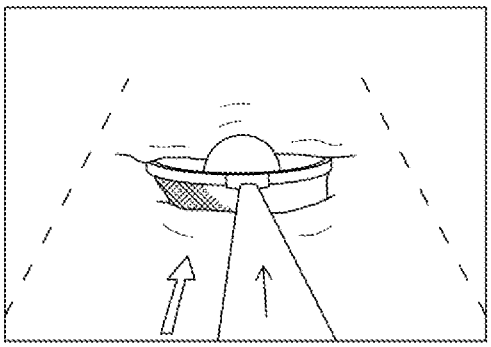
FIG. 13B illustrates initial position of the skimmer frame as the operator pushes the frame directly forward from the starting position illustrated in FIG. 13A, according to an embodiment of the present disclosure.
Figure 13H:
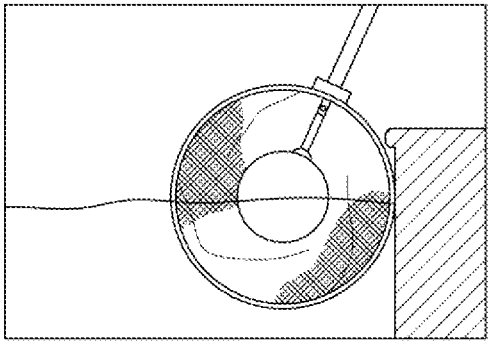
FIG. 13H illustrates a rotational position of the skimmer frame to about a 90° angle adjacent to the side of a pool wall, according to an embodiment of the present disclosure.
Figure 13A:
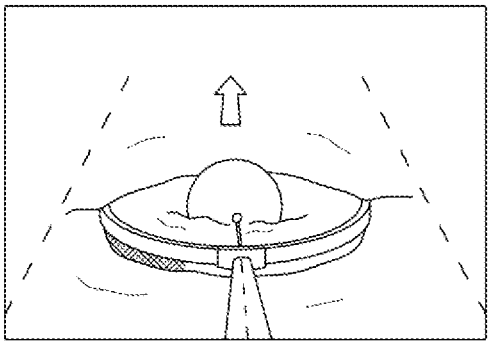
FIG. 13A illustrates a buoyant skimmer device in a starting position in the water prior to the skimming process, according to an embodiment of the present disclosure.

FIG. 13A illustrates a buoyant skimmer device in a starting position in the water with the front half of the frame and net submerged with the central flotation element keeping the frame and net at the waterline ready to start collecting debris. Whether pushing the skimmer away with the open area facing forward and up, rotating 180 degrees and pulling back toward the operator with the open face now looking down, or any lateral movement, even with the pole vertical while walking around the pool cleaning the edges, the device stays perfectly centered on the waterline collecting debris with minimal effort. The current embodiment has a frame diameter of 18 inches and no matter the direction the skimmer is headed, an 18-inch-wide path is easily skimmed. As the skimmer moves through the water, the central float creates a 19-20-degree wake that directs all debris in its path cleanly within the width of the frame for collection in the net. If debris accumulating in the net starts to cause drag that slows forward movement, then the skimmer is simply lifted from the water, the tab at the bottom of the net is grabbed and the debris is dumped out of the net with a shaking action. If there is a large amount of debris to be removed from the net the float assembly is easily removed and reattached with simple ¼ turns of the thumb screw.

FIG. 13B illustrates the initial movement of the skimmer frame as the operator pushes the frame directly forward from the starting position illustrated in FIG. 13A by using effort free hand over hand advancement of the pole, according to an embodiment of the present disclosure.

FIG. 13C depicts a rotational position of the skimmer frame to about a 45° angle in reference to the starting position illustrated in FIG. 13A. The operator exerts a slight lateral force to the right side of the pole to move the skimmer frame to the left while applying a slight counterclockwise movement to the pole to keep the opening in the net facing the direction of travel. FIG. 13D illustrates a rotational position of the skimmer frame to about a full left 90° angle in reference to the starting position illustrated in FIG. 13A, according to an embodiment of the present disclosure. FIG. 13D shows the point where the skimmer frame is in a full left 90° angle from the starting position, at that point the operator can either continue maneuvering the skimmer in a leftward direction by maintaining lateral force on the right side of the pole or immediately head in another direction by changing their standing or walking position at poolside.

FIG. 13E illustrates a rotational position of the skimmer frame to about a 135° angle in reference to the starting position illustrated in FIG. 13A, according to an embodiment of the present disclosure. At the start of this turn the operator is diminishing lateral force with the right hand while slightly rotating the pole counterclockwise while starting to pull the pole toward them through the turn.

FIG. 13F illustrates that rotation has stopped and the skimmer is now inverted to a full 180° angle in reference to the starting position illustrated in FIG. 13A, according to an embodiment of the present disclosure. Motion did not stop and the face down skimmer is heading back towards the operator. The central floatation element keeps the skimmer frame and net centered on the waterline with the trailing 50% of the frame and net under water and still efficiently and effortlessly collecting debris.

FIG. 13G illustrates a rotational position of the skimmer frame to about a 225° angle in reference to the starting position illustrated in FIG. 13A, according to an embodiment of the present disclosure. As shown in FIG. 13G the operator moves the skimmer to the right to collect floating debris. The operator is now putting the needed force on the left side of the pole to move the skimmer to right while rotating the pole counterclockwise to coordinate the net opening with the forward direction of the buoyant skimmer apparatus. The operator decides to empty the net and simply lifts the skimmer from the water to perform that task.

FIG. 13H Illustrates how the operator, after emptying the net, decides to skim the perimeter of the pool and positions the skimmer in the water at about a 90° angle adjacent to the pool wall, according to an embodiment of the present disclosure. The operator simply walks around the edge of the pool guiding the skimmer frame's plastic edge against the side wall of the pool. The curvature of the frame allows the skimmer to make contact with the pool wall or decorative tile recessed under any protruding deck or coping.

When the skimmer is moved forward, the net opening faces upward, with the float at the waterline and water flowing into the debris collection net both at and below the waterline. This orientation is maintained regardless of the direction and rotation of the frame. Lateral movement is achieved by using one hand on the pole to create a fulcrum, while the other hand applies lateral force ahead or behind the fulcrum to move the skimmer left or right. Fractional twisting of the pole, combined with push and pull movements, enables the net opening to face any direction of travel at any time.

Positioning of the float at a central location within the frame allows the immediate flipping and turning of the skimmer. By performing a quick 180-degree half-twist of the pole at the end of a long push across the pool, the skimmer instantly flips with its opening facing downward, while maintaining the same debris collection efficiency due to the float's centered position at the waterline. The ability to rotate the frame 360° allows for seamless and coordinated transitions and efficient cleaning in all directions.

The float's placement and the round shape of the frame contribute to effective debris collection. As water moves over the float's curved surface, its speed accelerates, aiding in drawing floating debris into the collection net. The float's positioning at the waterline ensures that debris is captured within the frame without spillage outside of its perimeter.

A person with ordinary skills in the art will appreciate that the systems, modules, and sub-modules have been illustrated and explained to serve as examples and should not be considered limiting in any manner. It will be further appreciated that the variants of the above disclosed system elements, modules, and other features and functions, or alternatives thereof, may be combined to create other different systems or applications.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. A buoyant skimmer apparatus for cleaning debris on, about and below a surface of a body of water, the buoyant skimmer apparatus comprising:

a handle wherein the handle is further connected to a pole;

a frame configured in a generally circular shape having a center point and wherein the handle is securely attached to the frame;

a mesh attached to the frame, wherein the mesh is configured in the a shape of a net to collect debris from the body of water; and a float assembly comprising a float attachment rod and a float which has a pivot point at a center of the float and wherein the center of the float is positioned at the center point of the frame at a collinear point along a central axis line that runs through the frame, the float, the handle and the pole, wherein the float assembly is attached to the handle, and wherein the float is securely attached to the float attachment rod so that the float is positioned at or about the center point of the skimmer frame to support the frame for 360° rotational movement and directional movement on, about and below the surface of the water.

2. The buoyant skimmer apparatus as claimed in claim 1, wherein the a positive buoyancy factor of the float is based on the total weight of the apparatus including a weight of a pre-defined length of the pole wherein the buoyant skimmer apparatus maintains the frame at a half-submerged position on or about the surface of the water regardless of direction of travel and degree of rotation of the frame or angle of the pole to the water.

3. The buoyant skimmer apparatus as claimed in claim 1, wherein the float attachment rod comprises a first end having a raised annular portion and having internal threading which securely attaches the float to the first end of the float attachment rod, wherein the float is provided with a protrusion with external threading that securely attaches the float to the first end of the float attachment rod.

4. The buoyant skimmer apparatus as claimed in claim 3, further comprising a notched transitional support member having a first portion and a second portion, wherein the first portion has an annular profile for a rod receiving opening and wherein the second portion having a rectangular profile, wherein an annular notch is between the first portion and the second portion of the notched transitional support member.

5. The buoyant skimmer apparatus as claimed in claim 4, wherein the frame having a first leg end and a second leg end that are connecting points to the handle which are inserted into the handle and wherein the float attachment rod is securely attached to the first portion of the notched transitional support member, and the second portion is fixedly attached to the handle by inserting the second portion having substantially rectangular profile inside the handle in between the first leg end and the second leg end of the frame.

6. The buoyant skimmer apparatus as claimed in claim 5, wherein the handle comprises a top portion and a bottom portion and wherein the top portion and the bottom portion of the handle have a half circle cutout so that when the bottom portion and the top portion of the handle are secured together a handle opening is formed in the handle to allow the annular notch between the first portion and the second portion of the notched transitional support member to line up with the handle opening, wherein thereby securing the frame and notched transitional support member within the handle.

7. The buoyant skimmer apparatus as claimed in claim 1, wherein the float assembly is securely attached to the handle using a handle attachment mount, wherein the handle attachment mount comprises a first annular portion and a second triangular portion, wherein the first annular portion having an annular opening that is configured to receive the float attachment rod and wherein the second triangular portion having a substantially triangular profile that attaches the handle attachment mount to the top portion of the handle, and wherein the first annular portion and the second triangular portion are offset and parallel to each other and the first annular portion is positioned at a point on the central axis line.

8. The buoyant skimmer apparatus as claimed in claim 1, wherein a shape of the float is spherical.

9. A buoyant skimmer apparatus for cleaning debris on, about and below a surface of a body of water the buoyant skimmer apparatus comprising:

a handle wherein the handle is further connected to a pole;

a frame configured in a generally circular shape having a center point and wherein the handle is securely attached to the frame;

a mesh attached to the frame, wherein the mesh is configured in the a shape of a net to collect debris from on or about the surface of the body of water; and a float assembly comprising a float attachment rod and a float which has a pivot point at a center of the float and wherein the center of the float is positioned at the center point of the frame at a collinear point along a central axis line that runs through the frame, the float, the handle and the pole, wherein the float assembly is attached to the frame, and wherein the float is securely attached to the float attachment rod so that the float is positioned at or about the center point of the skimmer frame to support the frame for 360° rotational movement and directional movement on, about and below the surface of the water.

10. The buoyant skimmer apparatus as claimed in claim 9, wherein an alternative cylindrical handle has an opening to receive a transitional support insert member and securely attached to the alternative cylindrical handle, and wherein the transitional support insert member further comprises a left outer slot, a central slot and a right outer slot and the frame having a first leg end and a second leg end.

11. The buoyant skimmer apparatus as claimed in claim 10, and wherein the left outer slot is used to attach the first leg end and the right outer slot is used to attach the second leg end and the central slot is used to securely attach the transitional support member which is further connected to the float attachment rod.

12. The buoyant skimmer apparatus as claimed in claim 9, wherein a shape of the float is spherical.

13. The buoyant skimmer apparatus as claimed in claim 9, wherein the float attachment rod or a rod attachment device has a slight downward angle from 2° to from center so that it positions the float at an alternative operational height within the frame.

14. A buoyant skimmer apparatus for cleaning debris on, about and below a surface of a body of water the buoyant skimmer apparatus comprising:

a handle wherein the handle is further connected to a pole;

a frame configured in a generally circular shape having a center point and wherein the handle is securely attached to the frame;

a mesh attached to the frame, wherein the mesh is configured in the a shape of a net to collect debris from the surface of the body of water; and a float assembly comprising a float attachment rod and a float which has a pivot point at a center of the float and wherein the center of the float is positioned at the center point of the frame at a collinear point along a central axis line that runs through the frame, the float, the handle and the pole, wherein the float assembly is attached to the pole, and wherein the float is securely attached to the float attachment rod so that the float is positioned at or about the center point of the skimmer frame to support the frame for 360° rotational movement and directional movement on, about and below the surface of the water.

15. The buoyant skimmer apparatus as claimed in claim 14, comprises a pole attachment bracket which is securely attached to the pole and wherein the float attachment rod is a generally Z-shaped rod with 45° offsetting angles so as to position the float to have a common central axis with the pole.

16. The buoyant skimmer apparatus as claimed in claim 15, wherein the pole attachment bracket comprises a first annular opening and a second annular opening, wherein the first annular opening is used to securely attach the float attachment rod and the second annular opening is used to securely attach the pole attachment bracket to the pole.

17. The buoyant skimmer apparatus as claimed in claim 14, wherein a shape of the float is spherical.

* * * * *